US005685768A

United States Patent [19]

Bernhard et al.

[11] Patent Number: 5,685,768

[45] Date of Patent: Nov. 11, 1997

[54] GRINDING MACHINE WITH LIFTING MECHANISM

[76] Inventors: Stephen Godfrey Bernhard, 2 Church Walk Bilton Rugby, Warwickshire CV21 3AZ; Kenneth Ian Fear, 23 Park Hill Gaddesby, Leicester LE7 4WH, both of United Kingdom

[21] Appl. No.: 383,515

[22] Filed: Feb. 3, 1995

[51] Int. Cl.[6] ..... B24B 7/07

[52] U.S. Cl. ..... 451/411; 451/178; 451/234; 414/545

[58] Field of Search ..... 451/411, 179, 451/178, 234; 414/545

[56] References Cited

U.S. PATENT DOCUMENTS

| | | | |
|---|---|---|---|
| 463,676 | 11/1891 | Bachelder et al. . | |
| 1,064,572 | 6/1913 | Trogdon | 451/411 |
| 1,088,922 | 3/1914 | Ochschim | 451/411 |
| 1,183,224 | 5/1916 | Oswald . | |
| 1,432,193 | 10/1922 | Lancaster . | |
| 1,513,527 | 10/1924 | Arnold . | |
| 1,884,641 | 10/1932 | Fitch | 187/253 |
| 1,968,609 | 7/1934 | Madsen | 51/173 |
| 2,517,947 | 8/1950 | Walker | 51/26 |
| 2,522,960 | 9/1950 | Price | 51/26 |
| 2,554,676 | 5/1951 | Masterson | 51/26 |
| 2,613,483 | 10/1952 | Lewis et al. | 51/173 |
| 2,747,344 | 5/1956 | Kickbush | 51/250 |
| 2,786,370 | 3/1957 | Osborn | 76/82.1 |
| 2,863,262 | 12/1958 | Turner et al. | 51/173 |
| 2,891,636 | 6/1959 | Krieger et al. | 187/213 |
| 3,175,332 | 3/1965 | Glaude | 451/411 |
| 3,246,777 | 4/1966 | Tabordon | 414/545 |
| 3,275,170 | 9/1966 | MacRae et al. | 414/545 |
| 3,771,267 | 11/1973 | Fortunski | 451/411 |
| 3,866,362 | 2/1975 | Riach et al. . | |
| 3,887,092 | 6/1975 | Leet | 414/545 |
| 3,996,818 | 12/1976 | Lindsay . | |
| 4,051,636 | 10/1977 | Heine | 451/411 |
| 4,821,458 | 4/1989 | Henson | 451/234 |
| 4,858,388 | 8/1989 | Bice | 451/411 |
| 5,062,322 | 11/1991 | Sinko | 76/82.1 |
| 5,159,784 | 11/1992 | Varner, Sr. et al. | 1/173 |
| 5,176,225 | 1/1993 | Nussbaum | 187/213 |
| 5,371,977 | 12/1994 | Liner | 451/349 |
| 5,513,943 | 5/1996 | Lugash et al. | 414/545 |

FOREIGN PATENT DOCUMENTS

| | | | |
|---|---|---|---|
| 4128483 | 3/1993 | Germany | 451/234 |

*Primary Examiner*—James G. Smith
*Assistant Examiner*—Dona C. Edwards
*Attorney, Agent, or Firm*—Deveau, Colton & Marquis

[57] ABSTRACT

A grinding machine for sharpening the blades of a mower. The grinding machine includes a lifting system for raising the mowing machine onto an operating platform where the blades are sharpened. A rotationally driven grinding wheel traverses its drive shaft in a controlled manner for sharpening each blade. A remotely mounted motor is coupled, by means of a flexible link and a motor coupling, to the mower's blade cylinder for rotating the blade cylinder during sharpening. The motor coupling is mounted to an adjustable mounting assembly for adjustment of the grinding machine to a variety of mower sizes and configurations. The lifting system includes a hydraulic cylinder which, upon extension, engages a drive chain to raise a lifting platform.

21 Claims, 5 Drawing Sheets

GRINDING MACHINE WITH LIFTING MECHANISM

BACKGROUND OF THE INVENTION

1. Field of the Invention

The invention relates to machinery for grinding equipment such as cylindrical blades for lawnmowers.

2. Brief Description of the Related Act

In known machinery, there is provided a platform on which to mount a mowing machine or lawnmower, or at least to mount the cylindrical blades thereof, adjacent a grinding wheel which is rotated on a main drive shaft operatively to engage the blades whilst rotating and thereby to sharpen the blades. The cylindrical blades, or helical rotating blades, are mounted in a specific orientation relative to the grinding wheel which is then drawn along the face of each of the blades of the cylinder so as to grind the face of each blade. To perform this operation it is known to provide three separate electrical motors, one for each of the tasks of driving the grinding wheel at high rotational speeds, traversing the grinding wheel along the blade, and rotating the blade cylinder. The motor for the latter function is positioned above the support platform on known grinding machines, and is generally relatively large. The motor for driving the mower cylinder blade in known machinery is therefore difficult to move and is an obstruction on the working surface of known grinding machines.

It is also known to provide a hoist or crane to lift a mower onto the operating platform of a grinding machine. However, the known hoists are relatively large accessory to a grinding machine and where such hoists are manually operated they are not always capable of handling larger mowers.

It is also known to provide a mechanism for relief grinding a cutting blade whereby the rear of the face of the blade is removed to reduce the area of the tip of the blade. This minimizes the breaking effect arising by interference between the rotating blade cylinder and the fixed bed knife of a mowing machine. The relief grinding operation can be performed using the known grinding wheel and a guide assembly such as that disclosed in U.S. Pat. No. 4,694,613 which requires a number of guide shafts fixed parallel to the drive shaft of the grinding wheel. Alternatively, it is possible to use a second grinding wheel to relief cut, or back off, the blades but in known apparatus there is not provided a satisfactory mechanism for accurately aligning the secondary grinding wheel and individual blades of a blade cylinder easily to provide a consistent relief cut along each of the blades.

SUMMARY OF THE INVENTION

Accordingly, the present invention seeks to avoid or at least mitigate these and other problems of the prior art. According to one aspect of he invention there is provided a grinding machine for grinding equipment such as cylindrical cutting blades of a mowing machine comprises a grinding wheel which is rotatable to grind a blade a moveable to traverse along a blade, means for securing cutting blades in an operating position relative to the grinding wheel and means for raising the equipment from below to substantial level with the operating position.

Adjacent aspects of the invention provides a lifting mechanism for raising an object such as a cutting blade substantially from ground level to an operating platform on a grinding machine, which mechanism comprises means for supporting the object during transport, and means for moving said support means between upper and lower position. Preferably, the moving means comprises a drive mechanism and a flexible elongate member for relaying a driving force from said live mechanism to said support means. The flexible elongate member can be fixable at one point relative to part of the drive mechanism and attachable at another point to a fixed position of the support means during movement thereof. The support means can comprises a bracket for connecting to the flexible elongate member which bracket extends upwardly from the support means. The drive mechanism can comprise a linearly moveable member which effects movement of said flexible elongate member. A guide for suitable controlling the movement of the support means during movement between said upper and lower positions can be provided. Also, the flexible elongate member can pass along part of said guide. A rotatable member can be provided wherein said flexible elongate member passes over said rotatable member and is directed thereby into said guide. Preferably, two flexible elongate members, each having an associated rotatable member and each being attachable to different parts of the support means can also be provided.

Another aspect of the invention provides a grinding machine for grinding cylindrical cutting blades comprises a grinding wheel mounted on a drive shaft and moveable axially along the shaft to traverse along the cutting face of a blade, and means for driving rotation and means for traversing the grind wheel wherein the driving means or the traversing means or both comprise hydraulic pumps operatively communicating with the means via a flexible link.

Yet another aspect of the invention provides a grinding machine for grinding cylindrical cutting blades comprises a main grinding wheel mounted on a drive shaft, means for adjusting the position of the drive shaft relative to means for securing the cutting blades in an operating position, a relief grinder to cut back a cutting blade which is attached to an assembly mounted on a support rail connectable to the adjusting means and one the drive shaft wherein the assembly is adjustable to vary the position of the grinder relative to the cutting blades and can be moved along the support rail and drive shaft to enable the relief grinder to cut the length of a cutting blade.

A further aspect of the invention provides grinding machine for grinding cylindrical cutting blades such as for a mowing machine, comprises a grinding wheel mounted on a drive shaft and moveable axially along the shaft to traverse along the cutting face of a blade, means for securely positioning the cutting blades adjacent the grinding wheel in an operating position and a motor to cause rotation of the cutting blades so that the cutting face is presented to he grinding wheel during its traversing movement, wherein the motor is positioned beneath the operating position and operatively communicates with the cutting blades via a flexible link.

Preferably the flexible link terminates at one end in a means for coupling to means for rotating the cylindrical blades. The coupling means is mounted adjacent the operating position using a universal locking device. The coupling means comprises a pulley mechanism. Preferably the motor and flexible link are connectable at each side of he machine thereby to enable adjustment of the machine to suite different types of mowers or cylindrical blades. Preferably the motor is a hydraulic pump and the coupling means is a hydraulic motor for converting the hydraulic pressure into mechanical rotational energy. The flexible link can be a sheathed rotatable cable.

BRIEF DESCRIPTION OF THE DRAWINGS

The invention will now be described, by way of example only, with reference to the accompanying drawings, in which.

DESCRIPTION OF THE PREFERRED EMBODIMENTS

Figure 2:
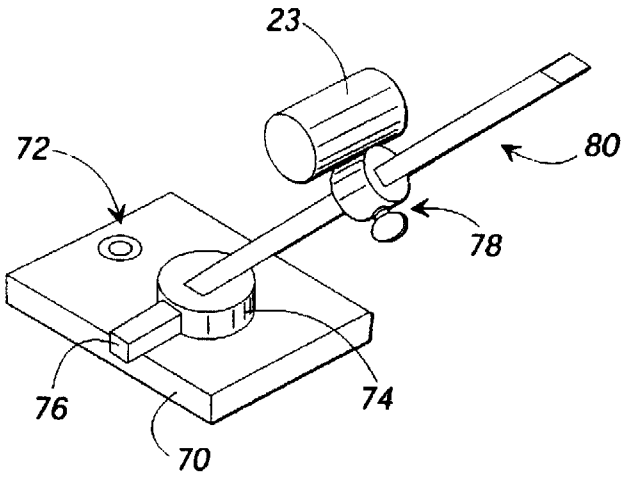
FIG. 2 is a perspective view of a mounting bracket for the cylinder drive motor shown in FIG. 1.

An example of a grinding machine 10 is shown comprising a main grinding wheel 12 mounted on a drive shaft 14 which is driven by an electric motor positioned beneath the operating platform 20. The motor can be screened from view by side panelling as in the figures. A mowing machine can be lifted onto the operation platform 20 using lifting system 40. The blades of the mowing machine are positioned adjacent the grinding wheel 12 and the mowing machine is locked in position using brackets or fixing mechanisms of known types which are not shown in FIG. 1. The position of the main grinding wheel 12 can be adjusted using adjuster assemblies 16 and 18 to vary the orientation of the grind stone relative to blades of a mowing machine.

In operation the grinding wheel 12 is driven by a first main motor at relatively high rotational speeds and it is also caused to traverse along drive shaft 14 using a second motor which can drive a slidable fork assembly to cause the traversing movement of the grinding wheel in a controlled manner. Additionally, the rotary blade cylinder of a mowing machine is rotated so that the entire face of each of the blades is ground. A third motor is provided to drive the blade cylinder where in this example of a grinding machine according to the invention, the motor is positioned beneath operating platform 20 and connected to a mechanical coupling 23 via a flexible link 24 which could for example be a sheathed cable which carries a rotatable inner cable. Flexible link 24 is connected to a drive motor via output couplings 26 which in this example are positioned at each side of the grinding machine. The couplings are connected to the mechanical by a lay shaft which spans the width of the machine. The motor coupling 23 and its mounting system are more clearly shown in FIG. 2. In order to enable easy adjustment of the position of the mechanical coupling 23, a universal bracket assembly is provided which is releasably clamped to the operating surface 20 in, for example, a mounting channel 21 such that the position of the mechanical coupling 23 can be moved from one side of the grinding machine to the other with relative ease. Also shown in FIG. 1 is a relief grinding system 30.

Referring to FIG. 2 there is shown a mounting assembly for the mechanical coupling 23 between the flexible link 24 and a mowing machine. The mounting assembly comprises a plate 70 which is mounted onto the operating surface 20 and fastened in position using a clamping device and locking nut 72 which can for example engage a locking channel 21 or other suitable fixing. Mechanical coupling 23 is attached to a locking bracket 78 which is slidable on a support arm 80 which is in turn rotatably mounted in a locking collar 74 comprising a socket for the ball end of arm 80. Collar 74 can be rotated using locking arm 76 in order to clamp the position of support arm 80 when the mechanical coupling 23 is properly positioned relative to a mowing machine.

In this example, three separate electromechanical motors are used in the main housing of the grinding machine 10. A particular advantage is derived from positioning the motor for driving the blade cylinder beneath the operating platform 20 and using a flexible link 24 to a mechanical coupling 23. However, it is also possible to use a hydraulic motor to pump fluids such as suitable oils around flexible tubing to drive hydraulic motors, or transducers which convert the energy of the pressurised hydraulic fluid into a mechanical system for rotating the cylinder blades or grindstone shaft or traversing mechanism for the grindstone. Again, where such a hydraulic system is used, the connection between the main hydraulic pump or motor positioned within the grinding machine and the relatively small motor or transducer coupling required at the operating platform 20 can be performed by flexible tubing which can be attached at either end of the grinding machine. Of course, a similar flexible link system to that described here could also be used to connect a motor with a relief grinding stone similar to the grinder described later on.

Figure 1:
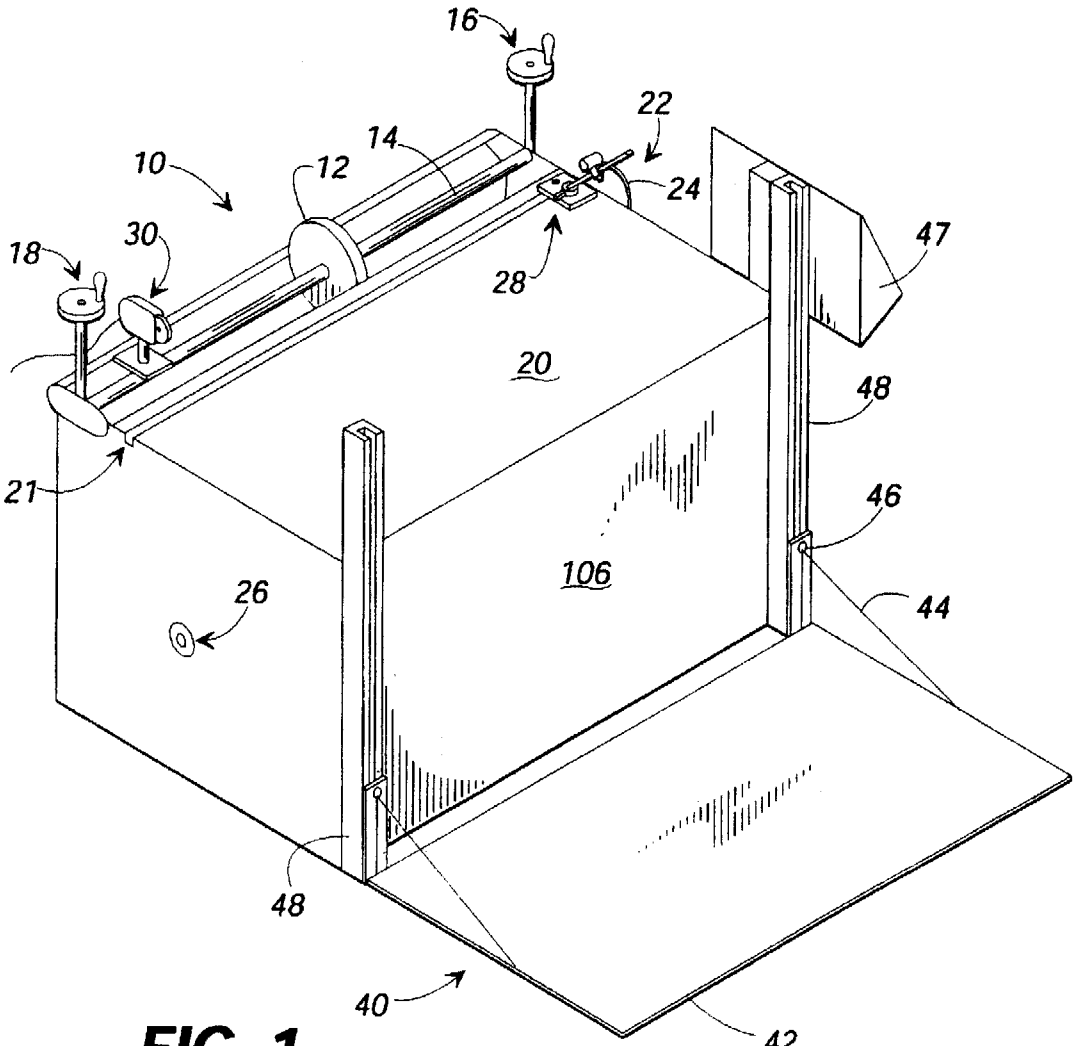
FIG. 1 is a perspective view from one side and above of a grinding machine according to the invention.
Figure 7:
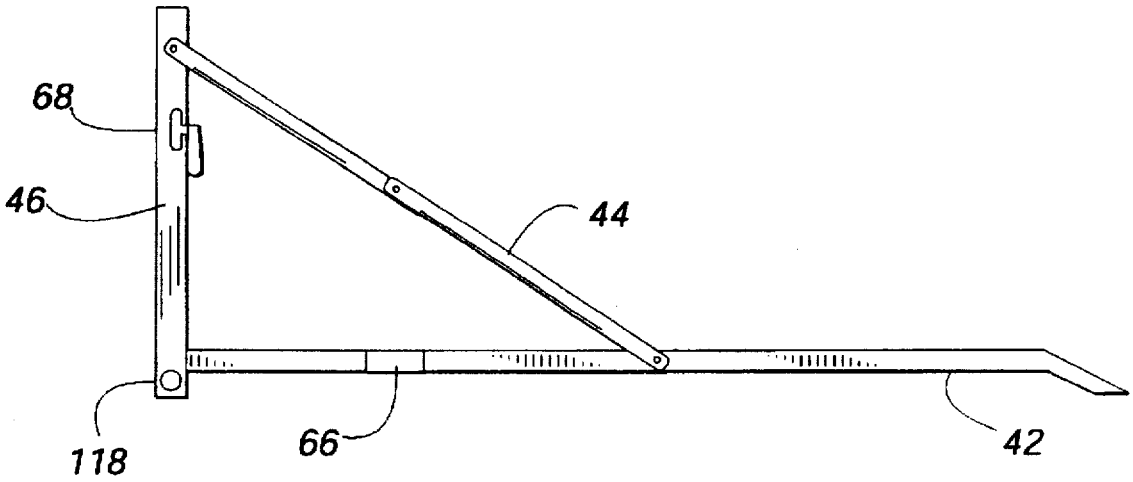
FIG. 7 is a schematic side elevation view of a platform for use in a lift according to the invention.

Referring to FIG. 1 there is shown a lifting system 40 used to raise a mowing machine onto the operating platform 20 of grinding machine 10. Lifting system 40 can comprise an adjustable lifting platform 42 which is connected pivotally to support brakckets 46 along one side and, as shown in FIG. 1, via detachable support cables 44 at positions along its ends. A different adjustment mechanism is shown in FIG. 7 and described later. The support brackets 46 are engaged in guide rail towers 48 and are connected to a drive mechanism such as mechanism 49 shown in FIG. 4 or mechanism 100 shown in FIG. 5. The support brackets 46 can be attached via a chain or cable attached to a motor for example thereby to raise and lower the lifting platform 42 from the ground up to the height of the operating platform 20. The lift mechanism can be provided with a control panel 47 which can be used to operate the lifting mechanism i.e. by stopping and starting a control motor and determining the direction of travel of platform 42. A master control panel can be provided, for example, to operate the various motors provided on grinding machine 10 as well as the lift mechanism in an integrated system.

Figure 3:
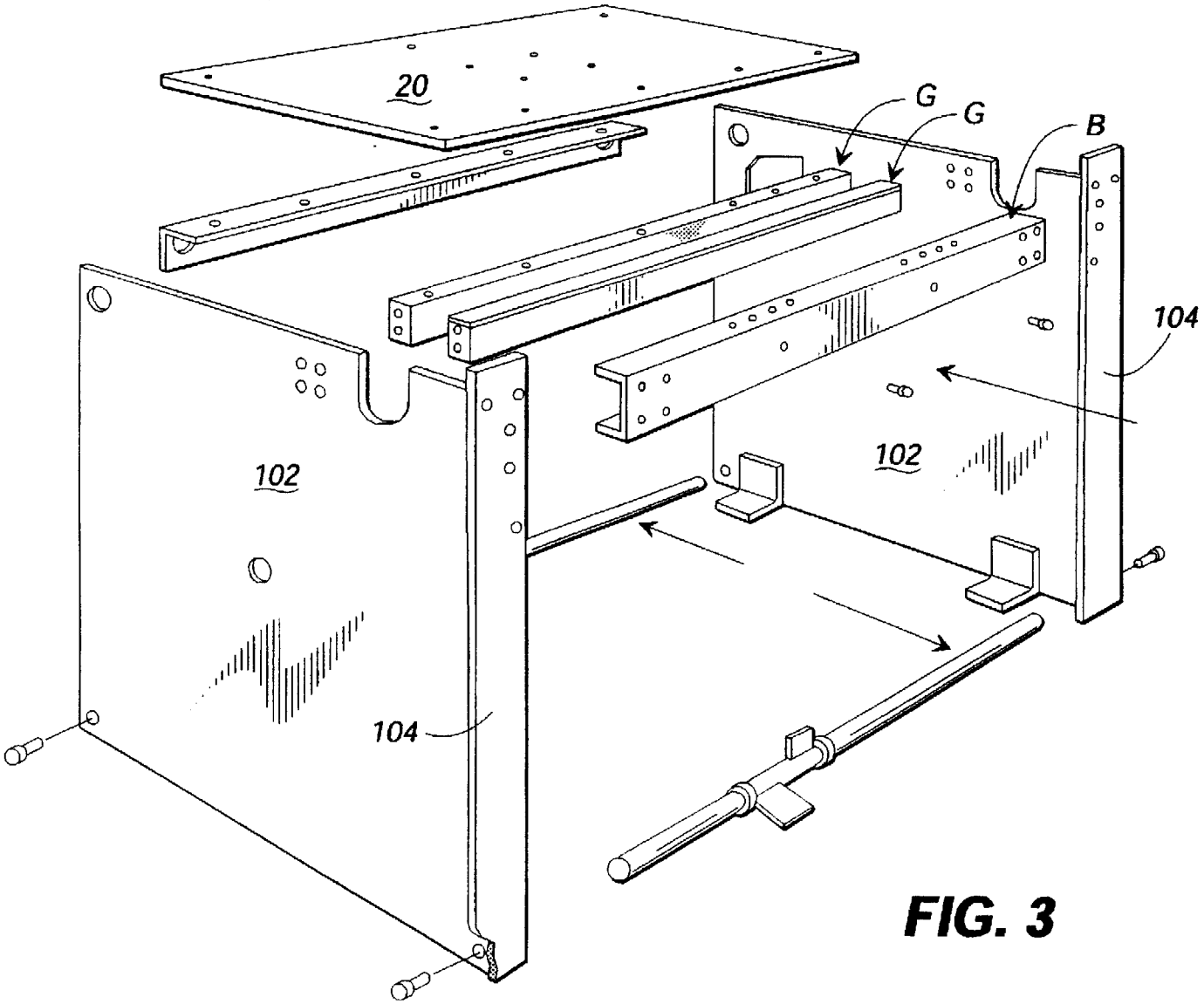
FIG. 3 is a perspective view of a cabinet for the machine shown in FIG. 1 in an exploded form.

FIG. 3 shows an exploded view of a cabinet which might be used to form the grinding machine 10 shown in FIG. 1. It can be seen that corner end plates 104 are provided on the cabinet to which a lifting system such as 40 shown in FIG. 4 can be attached. Naturally, columns 104 could be positioned on any side or end of the cabinet. In the cabinet embodiment shown by FIG. 3, lifting system 40 can be mounted at the side adjacent the edge of the operating platform 20 next to cross beams G and B.

Figure 4:
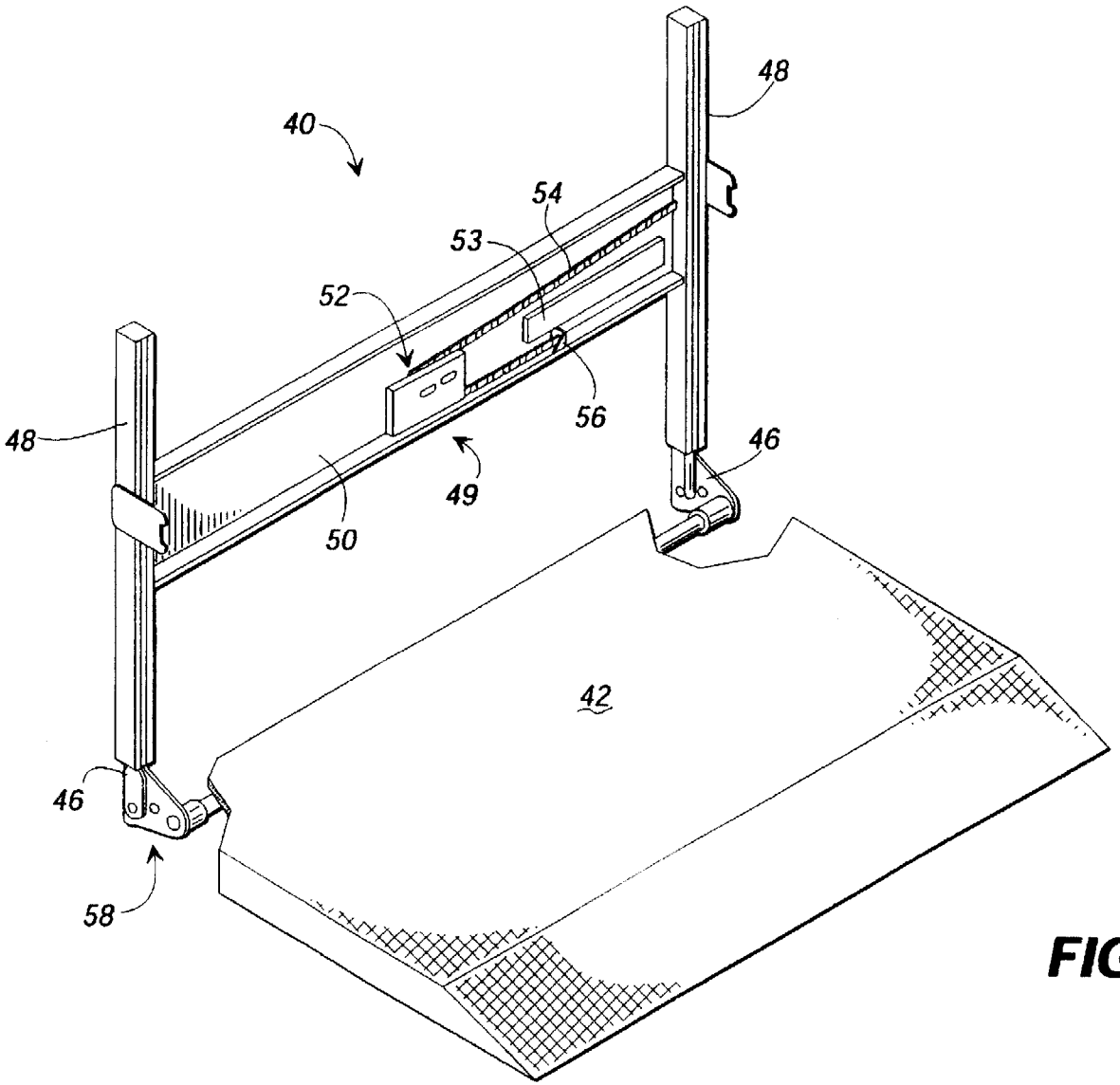
FIG. 4 is a perspective view of a lifting mechanism according to the invention.
Figure 5:
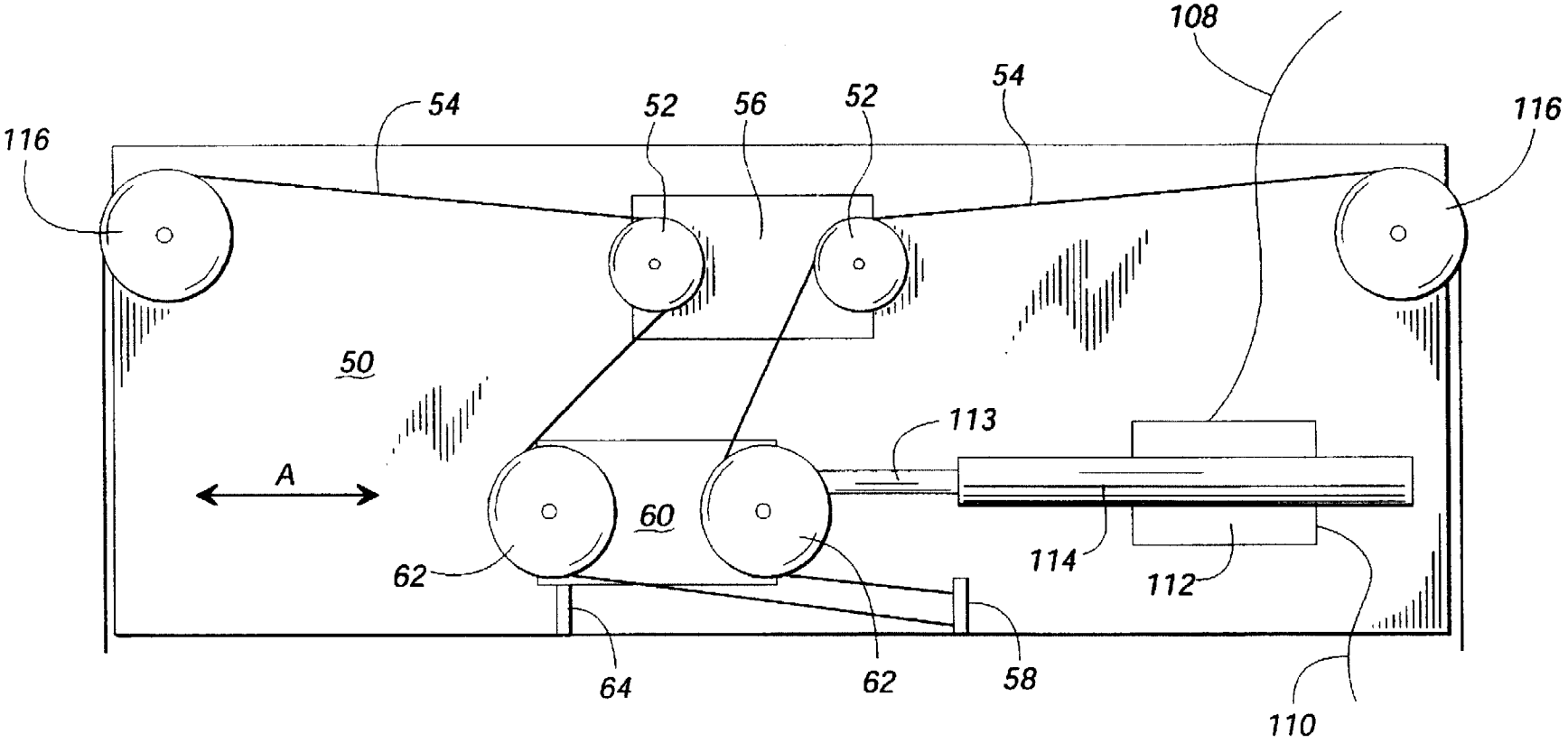
FIG. 5 is a schematic front elevation view of a second drive mechanism for the lift according to the invention.

In FIG. 4 there is shown a lifting system 40 which can be provided as a separate unit for attachment to a machine 10 such a shown in FIGS. 1 or 3. The system comprises upright guide rails 48, across member 50 housing a drive mechanism 49 and drive linkage to platform 42. Platform 42 is pivotally attached at pivots 58 to support brackets 46 which are engaged in guide rails 48. In this example, a single chain 54 is fixedly attached at boss 56 to cross member 50 at one end and to support bracket 46 at the other end. The chain 54 is entrained about a sprocket within movable member 52 such that when ram 53 is actuated thereby to cause movement of member 52, chain 54 is caused to move thereby effecting movement of the support platform 42.

In another example of a drive mechanism 100 according to the invention, there is provided a ram 114 which can be hydraulically or pneumatically driven for example by a pressure control unit 112 which can be powered from a source via cable 110. Cable 108 can connect the control 112 to an operating panel such as 47 shown in FIG. 1. Thus, on actuation of ram 114, piston 113 can be caused to move thereby causing movement of moveable member 60 about which two drive chains 54 are entrained. As can be seen from FIG. 5 the chains 54 are each entrained about a sprocket 116 at the ends of cross member 50 thus providing that the chains pass into guide rails 48. The chains are also entrained about sprockets 52 attached to a fixed member 56 prior to passing over sprockets 62 attached to moveable member 60. Finally, the chains are fixedly attached to cross member 50 at boss 58. By moving moveable member 60 backward and forward along the direction of arrow A, the position of a platform 42 can be adjusted. Of course, the flexible members connecting the drive system 112, 114 to platform 42 may not be chains but could be a chord, cable or other elongate member for example.

Figure 6:
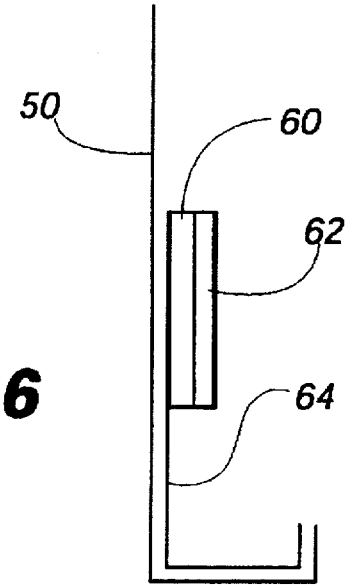
FIG. 6 is a schematic side elevation view of part of the mechanism shown in FIG. 5.

Preferably a guide 64 is used to maintain a constant direction of travel of moveable member 60. As seen in FIG. 6, guide 64 can be shaped in a suitable form here it is an L shape, to correspond to adjacent parts of cross member 50. Preferably guide 64 is lubricated for example with grease and positioned very close to cross member 50.

As previously discussed earlier, the platform 42 is preferably pivotally attached to support brackets 46 thus enabling the platform to be lowered into a horizontal position ready for use or raised to a substantially upright position for storage. A suitable system for adjusting platform 42 is shown in FIG. 7 wherein the upright support brackets 46 comprise pivots 118 which are connected to platform 42 and a bendable strut 44 is provided having a central pivot for adjustment of the strut and being pivotally connected to support bracket 46 at one end and platform 42 at the other end. Preferably, a means of securing platform 42 in an upright position is provided which can for example consist of a lug 66 having an aperture which might pass over a key lug such as 68 attached to support bracket 46.

This type of lift is particularly beneficial because of its safety feature of being able to raise the lifting platform 42 into a vertical position.

The present invention has been described with reference to the preferred embodiments. These embodiments, however, are merely for example only and the present invention is not restricted thereto. It will be understood by those skilled in the art that variations and modifications can easily be made within the scope of the present invention as defined by the appended claims.

What is claimed is:

1. A grinding machine comprising (a) a lifting mechanism for raising an assembly comprising a rotary blade cylinder having at least one cutting blade substantially from ground level to an operating platform;

(b) a grinding wheel for sharpening the at least one cutting blade; and (c) means for rotating said rotary blade cylinder, said means for rotating comprising a mechanical coupling.

2. A grinding machine according to claim 1 wherein the lifting mechanism comprises a linear drive actuator and a flexible member for transmitting a driving force from said linear drive actuator to a lifting platform.

3. A grinding machine according to claim 2 wherein said flexible member is a chain having a fixed first end.

4. A grinding machine according to claim 3 wherein the lifting mechanism further comprises a bracket for connecting a second end of said chain to said lifting platform.

5. A grinding machine according to claim 4 further comprising guide rail components which engage said brackets for controlling movement of said lifting platform.

6. A grinding machine according to claim 5 wherein a portion of the flexible member passes through a portion of said guide rail components.

7. A grinding machine according to claim 6 further comprising a rotatable member which engages said flexible member and wherein said flexible member passes over said rotatable member and into said guide rail components.

8. A grinding machine according to claim 7 comprising two flexible members, each having an associated rotatable member and each being attached to a portion of said lifting platform.

9. A grinding machine according to claim 7 wherein said rotatable member comprises a sprocket.

10. A grinding machine according to claim 2 wherein said linear drive actuator comprises a fluid driven piston-cylinder ram.

11. A grinding machine according to claim 1, wherein said means for rotating further comprises a flexible link connected to said mechanical coupling.

12. A grinding machine for sharpening a blade of a mowing machine, the mowing machine comprising a rotary blade cylinder, said grinding machine comprising:

(a) an operating platform for supporting the rotary blade cylinder in a raised position;

(b) a lifting system for raising the rotary blade cylinder onto said operating platform, from a lower position to the raised position;

(c) a grinding wheel assembly attached to said operating platform; and (d) coupling means, movable along said operating platform, for engaging and rotating the rotary blade cylinder when the rotary blade cylinder is in the raised position.

13. The grinding machine of claim 12 wherein said lifting system comprises a lifting platform movable between a first position adjacent the ground and a second position adjacent said operating platform.

14. The grinding machine of claim 13 wherein said lifting system further comprises a drive mechanism comprising a fluid-driven linear actuator which engages a flexible member for transmitting a driving force from said linear actuator to said lifting platform.

15. The grinding machine of claim 14 wherein said lifting system further comprises a sprocket assembly comprising at least a first sprocket, said sprocket assembly being connected to said linear actuator and movable between an extended position and a retracted position, and wherein said flexible member comprises at least a first chain having a fixed first end and a second end coupled to said lifting platform, a portion of said first chain engaging said first sprocket whereby movement of said sprocket assembly from said retracted position to said extended position raises said lifting platform from the first position to the second position.

16. The grinding machine of claim 15 wherein said lifting system further comprises a second chain having a fixed first end and a second end coupled to said lifting platform, said sprocket assembly further comprising a second sprocket engaging a portion of said second chain.

17. The grinding machine of claim 16 wherein said lifting system further comprises first and second brackets pivotally connected to opposite ends of said lifting platform, and wherein said first chain is coupled to said first bracket and said second chain is coupled to said second bracket, said first and second brackets being slideably engaged within first and second guide rail components, respectively.

18. The grinding machine of claim 12 wherein said operating platform comprises a mounting channel, and wherein said coupling means comprises a mounting plate movable along said mounting channel, said mounting plate comprising a locking nut for engaging said mounting channel and fastening said coupling means in position on said operating platform.

19. The grinding machine of claim 18 wherein said coupling means further comprises a mechanical coupling for engaging and rotating the rotary blade cylinder and a flexible link for transmitting power to said motor coupling.

20. The grinding machine of claim 19 wherein said flexible link comprises a sheathed cable comprising a rotatable inner cable.

21. The grinding machine of claim 20 wherein said coupling means further comprises a support arm rotatably mounted to said mounting plate by means of a ball-and-socket coupling, said mechanical coupling being adjustably mounted to said support arm by means of a locking bracket.

* * * * *

UNITED STATES PATENT AND TRADEMARK OFFICE

CERTIFICATE OF CORRECTION

PATENT NO. : 5,685,768
DATED : November 11, 1997
INVENTOR(S) : Bernhard et al.

It is certified that error appears in the above-identified patent and that said Letters Patent is hereby corrected as shown below:

Title page,
Item [75], Inventors, replace "Steven Godfrey Bernhard" with -- Stephen Geoffrey Bernhard --

Signed and Sealed this

Third Day of May, 2005

JON W. DUDAS
*Director of the United States Patent and Trademark Office*